United States Patent [19]

Sick et al.

[11] Patent Number: 4,658,404

[45] Date of Patent: Apr. 14, 1987

[54] INDUCTION FURNACE WITH A FURNACE BOTTOM AND A LID

[75] Inventors: Georg Sick, Maintal; Otto Stenzel, Gründau; Heinz Kohnert, Rodenbach; Hans-Johann Kemmer, Rödermark, all of Fed. Rep. of Germany

[73] Assignee: Leybold-Heraeus GmbH, Cologne, Fed. Rep. of Germany

[21] Appl. No.: 897,320

[22] Filed: Aug. 18, 1986

[30] Foreign Application Priority Data

Aug. 27, 1985 [DE] Fed. Rep. of Germany ..... 3530471

[51] Int. Cl.[4] ..... F27B 14/02; H05B 5/00

[52] U.S. Cl. ..... 373/143; 373/151

[58] Field of Search ..... 373/140, 141, 142, 143, 373/146, 151, 152, 153, 155, 156; 266/240, 242, 245, 246, 247; 432/157, 160

[56] References Cited

U.S. PATENT DOCUMENTS

| | | | |
|---|---|---|---|
| 3,529,069 | 9/1970 | Fredriksson | 373/140 |
| 3,531,074 | 9/1970 | Zelley et al. | 266/240 |
| 3,751,854 | 8/1973 | Huwyler | 432/160 |
| 3,790,338 | 2/1974 | Duca | 373/143 |
| 4,227,033 | 10/1980 | Nikolov et al. | 373/140 |

*Primary Examiner*—Roy N. Envall, Jr.
*Attorney, Agent, or Firm*—Felfe & Lynch

[57] ABSTRACT

Disclosed is an induction furnace with a furnace bottom comprising a crucible, an induction winding and a gas-tight casing, also having a lid, for the furnace bottom, which lid has at least one gas connection, a charging valve and a pouring arrangement. The furnace bottom and lid are connected by a flange joint and tiltably mounted by means of a picot bearing and a drive about a tipping axis in a furnace stand. The pivot bearing is secured to the lid, the tipping mechanism engages the lid, and the furnace bottom is separable from the lid by unfastening the flange joint, the lid remaining in the furnace stand.

15 Claims, 8 Drawing Figures

FIG. 3
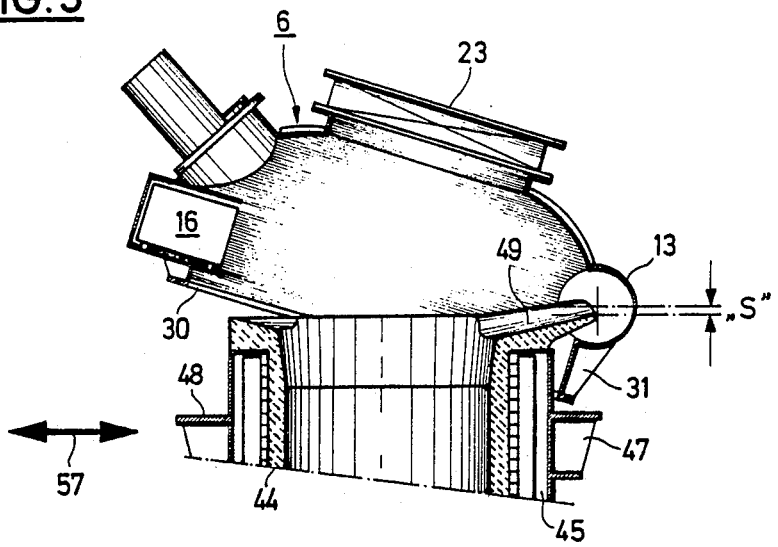
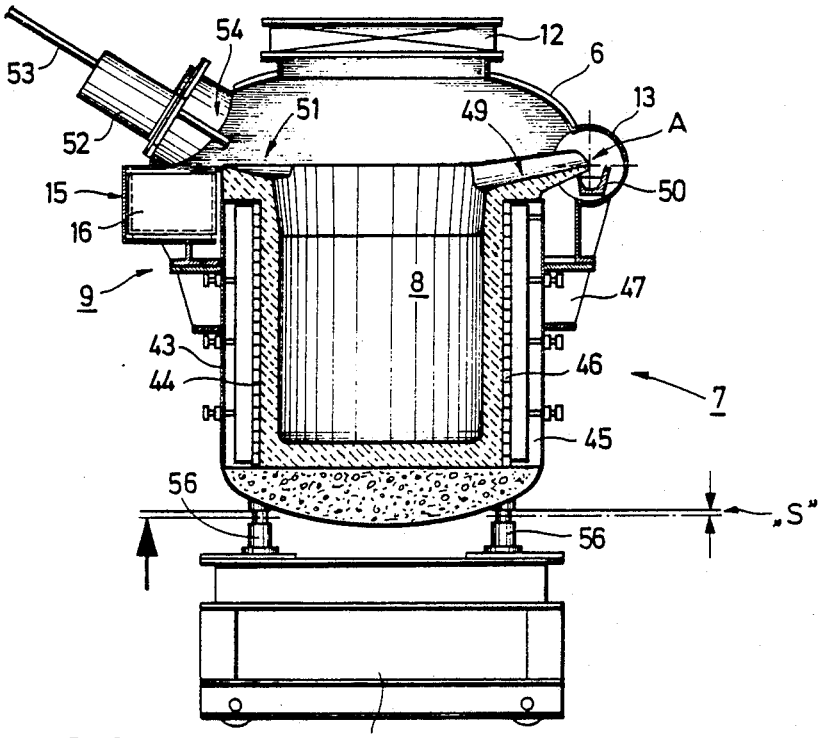
FIG. 2

INDUCTION FURNACE WITH A FURNACE BOTTOM AND A LID

BACKGROUND OF THE INVENTION

The invention relates to an induction furnace having a furnace bottom comprising a crucible, an induction winding and a gas-tight casing, having also a lid for the furnace bottom which has at least one gas connection, a charging valve and a pouring arrangement, in which the furance bottom and the lid are releasably, but in gas-tight manner, connected together and are tippably supported about a tipping axis in a furnace stand when connected, by a pivot bearing and a tipping mechanism.

In such gas-tight induction furances, which can be used with a shielding gas or under vacuum, materials are usually melted and held ready for casting which would suffer oxidation and/or would absorb gas if melted in air. Principally, such furnaces are used for melting metals which are relatively reactive at their melting temperature.

Such induction furnaces need a whole series of ancillary equipment which as a rule is affixed to the lid or connectable to the lid such as charging equipment, slag-removal equipment, measuring and monitoring equipment, pouring equipment etc. Also, the necessary gas connections for supplying a shielding gas or evacuation by vacuum pumps are usually attached to the lid.

In the known induction furnaces of the kind described above the hinge bearing for the tilting movement is on the furance bottom and also the tilting mechanism works on the furnace bottom. For this, the furnace bottom has a carrying frame which is supported by bearing spigots in a furnace stand. This method of construction however leads to a number of problems.

The crucible inside induction furnaces which comprises in the usual way a ceramic material and is usually also known as "brickwork", is subject to more or less rigorous wear, from thermal and mechanical demands. To the mechanical demands belong the movement of the melt usually occasioned by inductive stirring of the bath, which is applied not only for alloy formation but also for intensifying gas exchange. It is therefore in many cases necessary, after the melting of several charges, to examine the furnace bottom including the induction winding and to replace the crucible or the brickwork as necessary.

In the known induction furnaces described above it was arranged that one lifted off the freely movable lid and carried out the necessary inspection and repair work on the furnace bottom. However, in doing this, the lid, which, on account of its numerous attachments and fittings was a relatively expensive item, could not be further used and then the user had to have at his disposal a second complete induction furnace of the known type. So long as the furnace bottom remained in the furnace stand for carrying out the inspection and repair operations, this also compelled the associated vacuum pumps to be stopped, so that the productivity of the whole induction melting plant was greatly reduced. Here it is to be noted that the furnace lid with all its attachments and fittings and the furnace stand with the supply equipment for the induction melting plant needed to be inspected or serviced at very much greater time intervals.

The invention is based therefore on the problem of providing an induction furnace of the type described above in which the inspection and repair work on the furnace bottom can be carried out much more easily and in which the furnace lid with its costly attachments and fittings can also be used further during the inspection and repair work.

SUMMARY OF THE INVENTION

The solution to the set problem follows according to the invention in that the pivot bearing is fixed to the lid, that the tilting mechanism engages the lid and that the furnace bottom is separable from the lid after releasing the flange connection while the lid remains in the furnace stand.

Through the inventive solution the lid has in principle the function of a connecting platform which always remains in the furnace stand on the pivot bearing, in which also all the ancillary equipment such as gas connections, charging valve, pouring equipment, measuring and monitoring equipment can stay on the lid. To the gas connections in vacuum-induction furnaces are connected suction conduits which have a substantial cross-section, which are connected with the vacuum pumps by rotary joints.

It is, for the further utilisation of lid, furnace stand, supply equipment (power supply, cooling water and gas processing equipment) as well as vacuum pumps, simply necessary to have at one's disposal at least one further furnace bottom that can be substituted for the furnace bottom that is to be inspected or repaired. To remove the furnace bottom from the plant it is then only required to free the power and cooling water connections with the furnace bottom and induction winding and connect them up to the new furnace bottom. The whole melting plant is then in short order ready for use, while the furnace bottom needing repair can be made ready for use again at another location. In this way, the capital cost required for a given production is greatly reduced or the productivity of the entire melting plant is correspondingly increased without any substantial cost increase over and above the known principle of construction.

It is advantageous here according to a development of the invention if the lid is provided in the region of the tipping axis with a melt delivery pipe running substantially tangentially to the wall of the lid, in gas-tight connection with the lid and open to the interior of the lid and, if the crucible has a melt pouring spout, which projects into the melt delivery tube and terminates in the tipping axis.

The melt delivery tube, in which as a rule there is a ceramic pouring channel, leads—preferably via a rotary coupling—to a distributor tube by which the melt can be fed to various casting stations. Since the delivery tube is located in the region of the pivot bearing connected to the lid, the connection between delivery tube and distributor tube also remains when the furnace bottom is removed, so that also at this position, no dismantling work is required.

According to a further feature of the invention it is once again particularly advantageous if the lid, on the side diametrally opposite the melt delivery tube, is provided with a gas-tight projection, in which is located a slag-collection vessel, and if the crucible is provided on the side opposite the pouring spout with a pouring lip over which the slag can be run on tipping the crucible in the direction opposite to the pouring position.

Also this equipment, which can be referred to simply as "slag removal equipment" remains permanently connected with the furnace lid and through the pivot bearing of the invention also with the furnace stand and is furthermore ready to have a new furnace bottom fastened on.

It is here furthermore advantageous to provide the lid with a gas connection for a shielding gas, further if this gas attachment opens into the flange of the lid and communicates at its opening position with a gas conduit located in the flange of the furnace bottom, which opens into a space between the casing and the crucible, in which is located the induction winding.

In this fashion it is possible to remove any moisture that might come from the crucible or brickwork from the furnace bottom, so that the usual influx of steam into the melt gas atmosphere can be prevented (gas scavenging).

The avoidance of free moisture is then additionally facilitated if, at the side of the flange joint opposite the opening position, there is a further gas conduit and a suction conduit, which likewise communicate with each other across the flange joint. Preferably here is arranged an additional blower or pump in the suction conduit, which produces an additional pressure drop compared to the melt gas atmosphere. This has the following effect:

When using a shielding gas, the incoming main gas flow divides into one gas flow circulating in the melt zone and a subsidiary gas flow circulating in the space containing the induction winding. The ventilator arranged in the suction conduit, i.e. at the outlet for the subsidiary gas flow, now produces a pressure difference between the melting zone and the said winding space. Through the lowered absolute pressure in the winding space, water freed from the crucible material is led away in the subsidiary gas stream and influx of water into the melt gas atmosphere is effectively prevented.

By the stated manner of construction the supply and exhaust conduits for the subsidiary flow of the protective gas are located in the lid, so that the connection with a gas treatment plant for drying and cleaning the shielding gas can remain permanently. The necessary connection with the furance bottom is automatically effected when it is attached to the lid without requiring the provision of further connections.

Finally it is, with a further embodiment of the invention, particularly advantageous if the tipping mechanism is comprises of a first pressure cylinder, which is connected at its upper end by a first connection with the framework of the lid and at its lower end by a second connection to a linkage of which the opposite end is mounted by a third connection on the furnace stand, wherein the first, second and third connections lie on the apices of a triangle and all the pivot axes extend parallel to the tipping axis. If here, furthermore the linkage is movable by at least one second pressure cylinder from a first pivotal region, for pouring, into a second pivotal region, for slag removal, it is possible by the cooperation of the first cylinder with the second cylinder via the linkage to produce a tipping movement of the induction furnace out of the horizontal position of the flange joint in one sense of rotation (e.g. for slag removal) and in the opposite sense (e.g. for pouring) without requiring the hiterto customary drive elements, which would require a hoist in the region of the furance stand.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive manner in which there is illustrated and described a preferred embodiment of the invention.

BRIEF DESCRIPTION OF THE DRAWINGS

FIG. 2 is a side elevation view in partial cutaway of the furnace bottom and the lid in a position like FIG. 1 in conjunction with a transport trolley for the furnace bottom;

FIG. 3 is a view of the upper part of FIG. 2 with a slightly upwardly pivoted lid for the sideways positioning (or removal) of the furnace bottom;

DESCRIPTION OF THE PREFERRED EMBODIMENT

Figure 1:
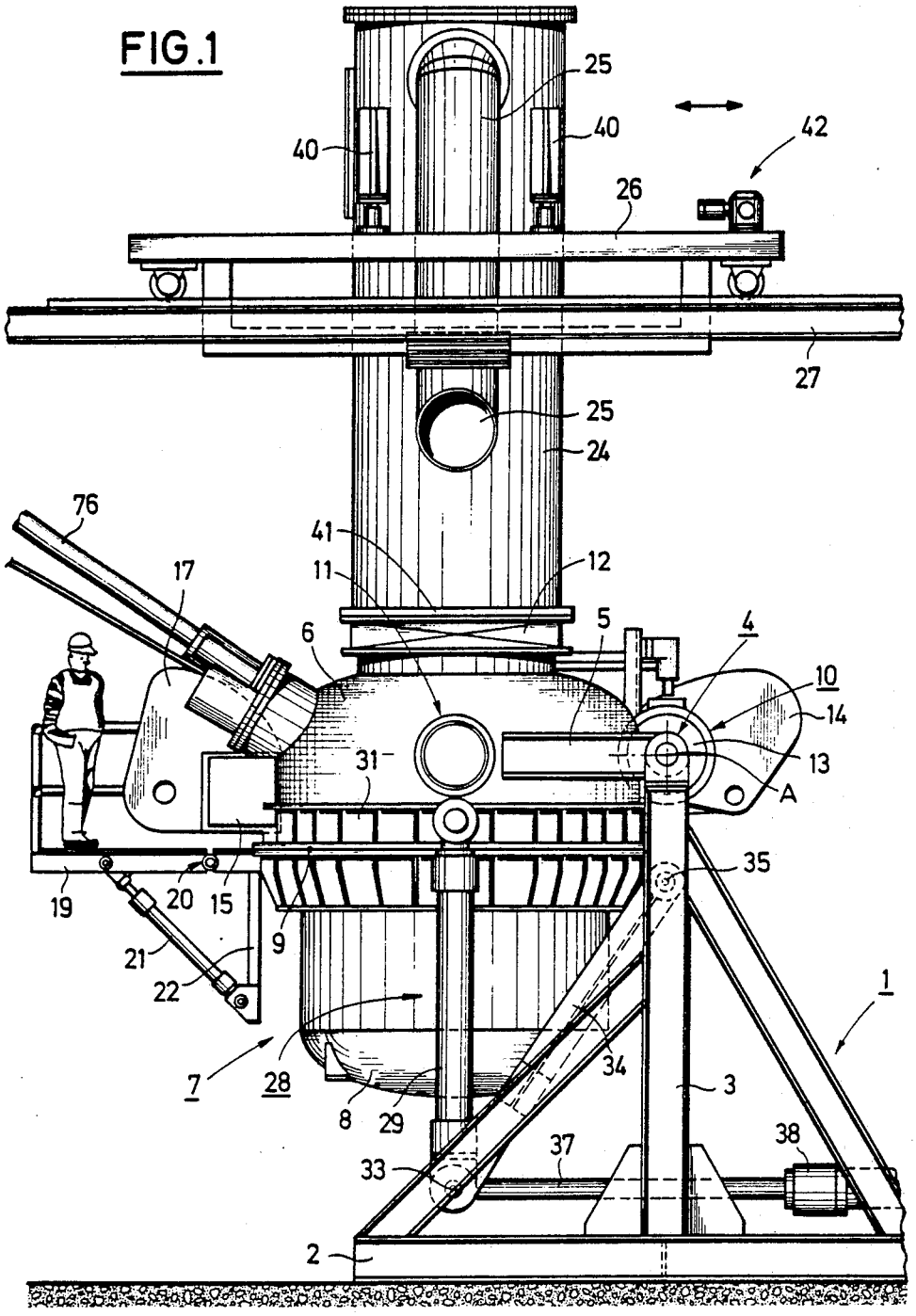
FIG. 1 is a side elevation view of the induction furnace in the charging or melting position i.e. with the flange joints horizontal.

Referring to the Figures and especially FIG. 1, a furnace stand 1 has a base frame 2 and two vertical supports 3 (onely one of which is shown in FIG. 1) at the upper end of each of which is arranged a pivot bearing 4. This pivot bearing comprises in the usual way a bearing housing and a bearing spigot and they are arranged one behind the other in the direction viewed. The further side of the pivot bearing 4 is secured by a cantilever 5 to a lid 6 of an induction furnace 7, to which belongs also a furnace bottom 8. Lid 6 and furnace bottom 8 are connected together in a gas-tight manner by a flange joint connection 9.

On the lid 6 are arranged additionally a pouring arrangement 10, a gas connection 11 and a charging valve 12, which, with the pivot bearing 4, are the principal components of the lid. The pivot bearing 4 defines a tipping axis A which runs perpendicular to the plane of the drawing.

Figure 7:
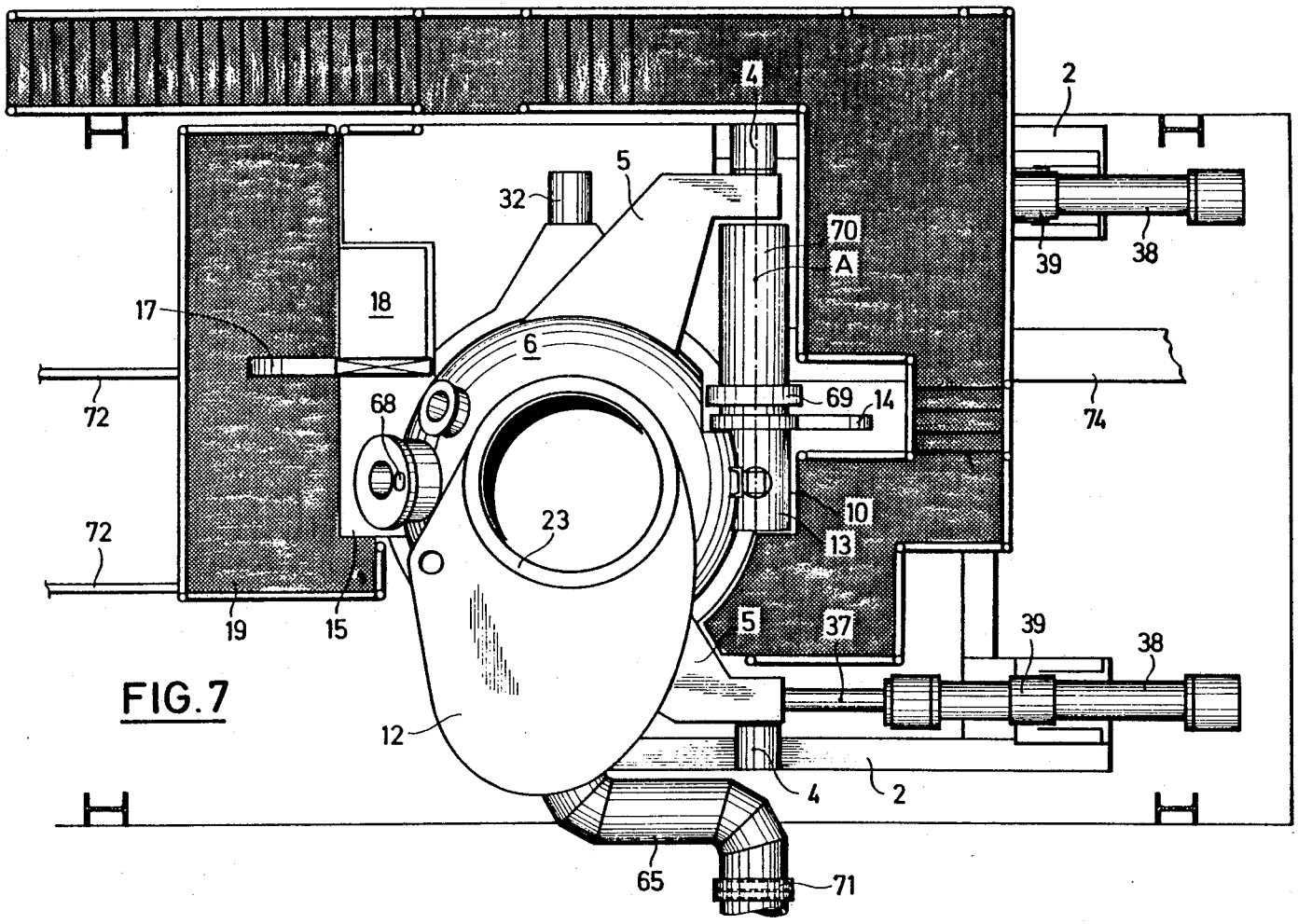
FIG. 7 is a plan view of the assembly of FIG. 1 without the charging vessel.

A very important component of the pouring arrangement 10 is a pouring pipe 13 which runs tangentially to the wall of the lid in the region of the tipping axis A, which is connected in a gas-tight manner with the lid and which is open to the interior of the lid. The pouring tube 13 is closed at its end in the plane of the drawing and is closable at its opposite end by a slide valve 14 (FIG. 7).

Figure 8:
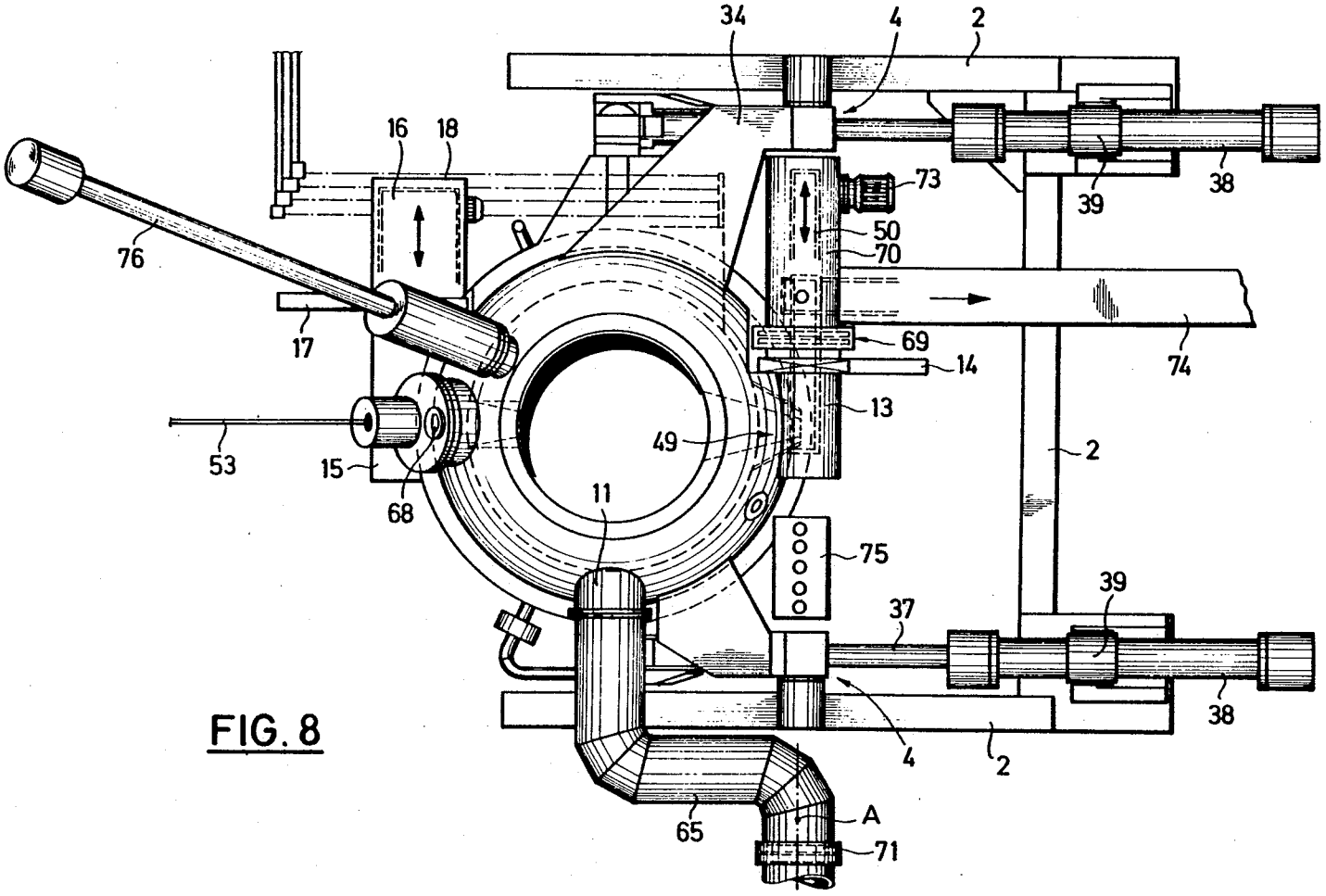
FIG. 8 is a simplified drawing of the assembly of FIG. 7 with a few details omitted for clarity and the internal construction shown partially in broken line.

On the side diametrally opposite the pouring pipe 13 the lid 6 is provided with a gas-tight projection 15, in which is located a slag-collection vessel 16 (FIG. 2). The projection 15 is connected by an air lock 17 with a removal chamber 18 in which the slag-collection vessel 16 can be removed (FIG. 8). In the region of the projection 15 and the removal chamber 18 a working platform 19 is attached to the lid 6 by a pivot 20, whereby the working platform 19 is supported from an outrigger 22 by a ram 21 which is also fixed to the lid 6. The operation of the ram 21 will be further explained below in connection with FIG. 5.

The charging valve 12 is arranged on top of the lid 6 and has a horizontal connecting flange 23 (FIG. 7) for connection with a charge hopper 24 which can be moved over the furnace. The charge hopper 24, which is also evacuable through suction conduit 25, rests on a trolley 26 which can travel parallel to the plane of the drawing on rails 27 which extend above the induction furnace and lead to a station (not shown) at which the charge hopper 24 can be loaded. The charge hopper 24 carries in its interior (not shown) a charge basket with a closable floor opening which can be lowered by a winch through the charging valve 12 into the induction furnace 7.

Figure 6:
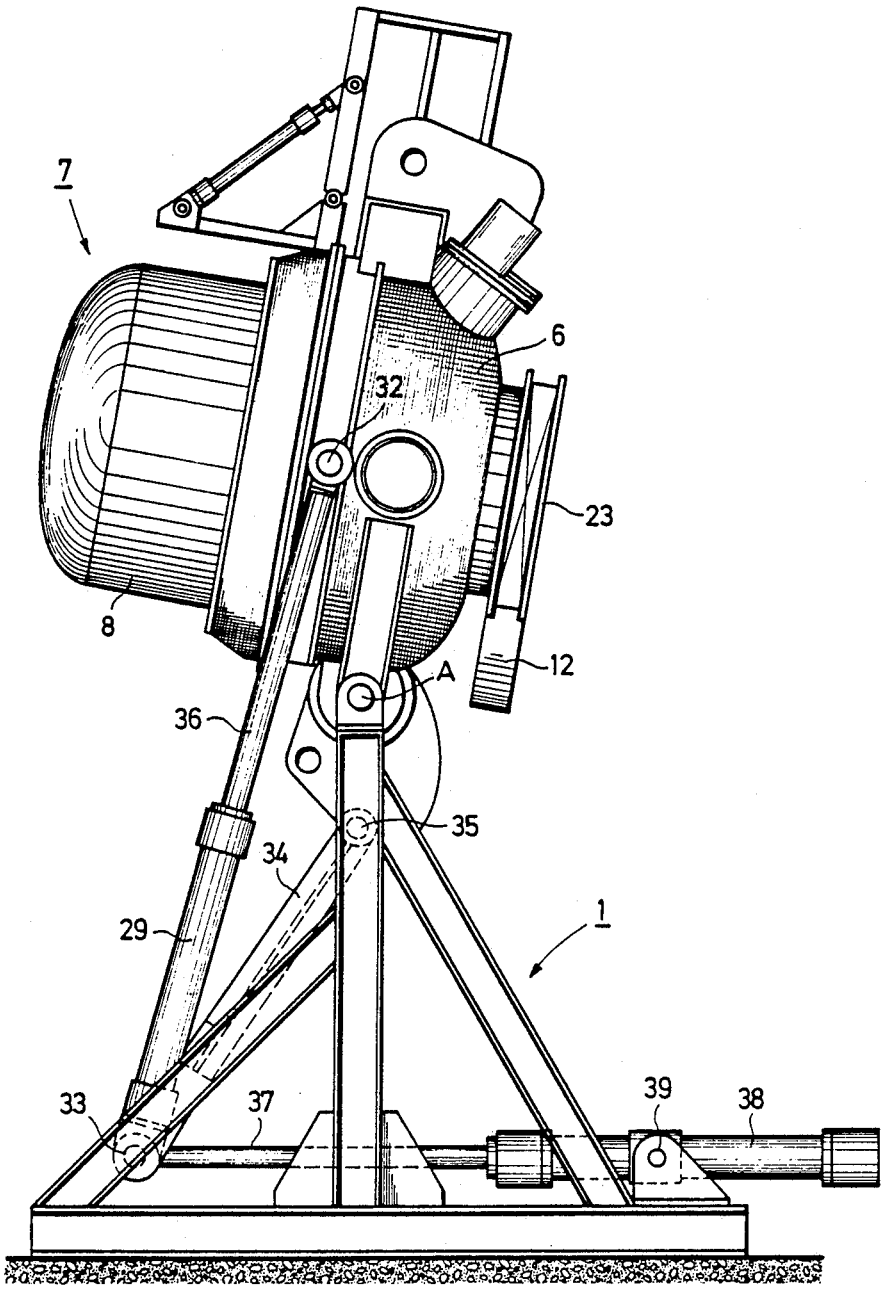
FIG. 6 is a view of the equipment of FIG. 5 (wihout charging vessel, however) in a rotated position.

The tipping movement of the induction furnace is naturally possible only after the sideways displacement of the charge hopper 24. To carry out this tipping movement about the tipping axis A there is provided a tipping mechanism 28, which includes a first pressure cylinder 29 of which the upper end engages the lid 6 which for this purpose is surrounded by a framework structure 31 in the region of its flange 30 (FIG. 3), on which the tipping mechanism 28 engages by means of a first pivot 32 (FIG. 6). The lower end of the pressure cylinder 29 is attached by a second pivot 33 to linkage 34 of which the opposite end is attached ot the furnace stand 1 by a third pivot 35. All the pivot axes run parallel to the tipping axis A and lie on the apices of a triangle, so that by altering the length of one side of this triangle, say by extending the piston rod 36 out of the pressure cylinder 29, the induction furnace can be tipped (FIG. 6).

Figure 5:
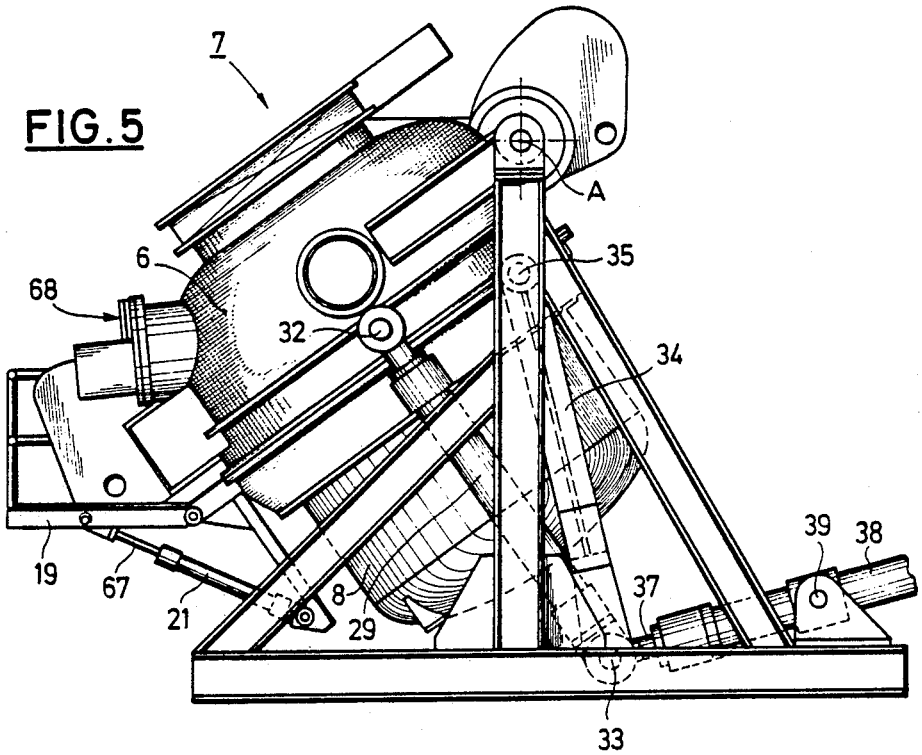
FIG. 5 is the induction furnace of FIG. 1 (without the charging vessel) in its end position after pouring.

The linkage 34 is held in its indicated position by the piston rod 37 of a second pressure cylinder 38, which is attached to a fourth pivot 39 (FIG. 5). The pivots 33, 35 and 39 also lie on the apices of a triangle, so that by altering the length of one side of this triangle, say, by retracting the piston rod 37 into the pressure cylinder 38, there is produced a pivoting movement of the induction furnace 7, this being in the opposite direction as in Figure 5. The pressure cylinder 38 here advantageously engages the linkage in the region of the pivot 33; it is however possible to provide an additional pivot location for this.

It can be seen from FIG. 1 that the charge hopper 24 is supported by four jacks 40 on the trolley 26 so that the lower flange 41 of the charge hopper 24 can be lifted from the attachment flange 23 before effecting a traversing movement of the charge hopper. A traction motor 42 serves to drive the trolley 26.

Figure 4:
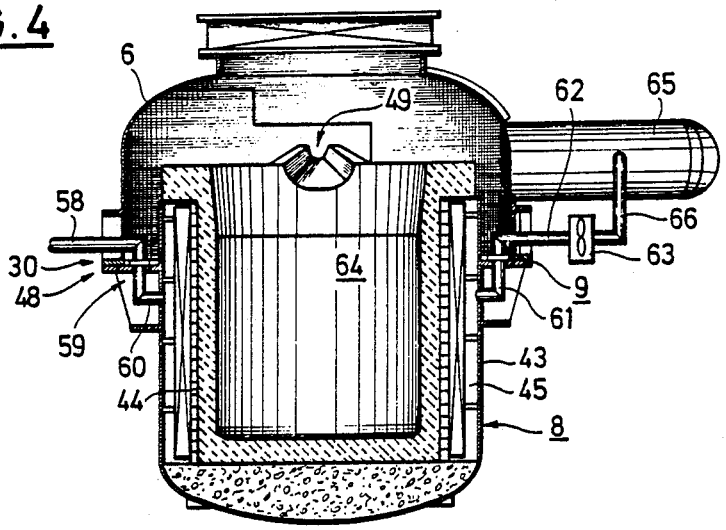
FIG. 4 is a side elevation view in partial cutaway of a furnace bottom with lid in a sectional plane rotated 90° from that of FIG. 2.

In FIG. 2 to 4 the internal construction of the induction furnace 7 is additionally shown. The furnace bottom 8 comprises a gas-tight casing 43, in which there is arranged, with radial spacing, a crucible 44 of ceramic material. Between the casing 43 and the crucible 44 is a space 45 in which an induction winding 46 is inserted. The casing 43 is somewhat below its upper rim, surrounded by a framework structure 47, which is bounded on its upper side by a flange 48 which can be mated with the flange 30 of the lid to form the gas-tight flange joint 9. It can be seen from FIG. 2 that the crucible 44 and the induction winding 46 extend a certain way into the lid 6. On one side the crucible 44 has a pouring spout 49 which extends into the pouring pipe 13 and terminates at the tipping axis A. Below the end of the pouring spout 49 is a ceramic channel 50 which will be explained further below in connection with FIG. 8. It is easily seen from FIGS. 2 and 3 that the end of the pouring spout 49 lies on the tipping axis A in all positions of the crucible 44.

On the side diametrally opposite the pouring spout 49, the crucible 44 is provided with a pouring lip 51 over which the slag can be passed into the slag-collecting vessel 16 by inclining the crucible as shown in FIG. 5 oppositely to the pouring position. To scrape off the slag there is a guideway 52 through which a scraper 54 can be guided in by an actuating rod 53.

In FIG. 2 is shown a transport trolley 55 beneath the furnace bottom 8 with jacks 56 by which the furnace bottom can be lowered a distance "S" before the lid 6 is raised by means of the tipping mechanism 28 to a position as shown in FIG. 3. In this position of the lid 6, the furnace bottom 8 can be moved out sideways in the direction of the double arrow 57 by means of the transport trolley 55, and moved back in again. Although the crucible 44 projects above the flange 48 by a not insubstantial amount, there is no obstruction of the relatively moveable parts and no damage to the pouring spout 49.

It can be seen from FIG. 4 that the lid 6 is also provided with a gas connection 58 for a shielding gas. This gas connection opens into the flange 30 of the lid 6 and communicates at the opening position 59 with a gas conduit 60 in the flange 48 of the furnace bottom 8, which opens into space 45 between the casing 43 and the crucible 44. At the side of the flange joint 9 opposite the opening position 59 there is in the furnace bottom a further gas conduit 61, and in the lid a suction conduit 62, the two conduits communicating with one another likewise across the flange joint 9. Further on, the suction conduit 62 has a blower 63 by which a pressure reduction can be produced in the space 45 as compared to the melt zone 64, by which the above described effect of extracting the steam is produced. The gases are led out of the melt zone 64 through a suction conduit 65 which is connected with the gas connection 11 (FIG. 1). The pressure side of the blower 63 opens via a conduit 66 into the suction conduit 65.

FIG. 5 shows the induction furnace 7 in the slag-removal position. The necesary tipping movement about the tipping axis A is effected by retracting the piston rod 37 into the pressure cylinder 38, whereby the linkage 34 and the lower pivot 33 for the pressure cylinder 29 are in the position shown in FIG. 5. In this, the upper pivot 32 of the bearing arrangement is followed by the lower pivot 33, whereby the induction furnace 7 is brought into the slag-removing position.

At the same time piston rod 67 of the mechanism 21 is extended and the working platform 19 is held in a reasonably horizontal position so that the slag-removing process can be observed by an operative through an inspection window 68 and controlled.

FIG. 6 shows the already described end position in pouring-off, i.e., the pivot 33 is, with an extended piston rod 37, in the position shown in FIG. 1 and then simply the piston rod 36 is continuously extended from the pressure cylinder 29 for the purpose of effecting the pouring process. It will be understood that in all of these operations the charging valve 12 is closed.

In FIG. 7 like parts are indicated by like reference numerals as before. What is easily seen is a stable location of the lid 6 over the two cantilevers 5 in the pivot bearing 4 and the direction coaxial thereto of a rotary coupling 69 through which the pouring pipe 13 is connected on its side of the slide valve 14 with a distributor pipe 70, also the coaxial arrangement of a rotary coupling 71 in the suction conduit 65. Finally, rails 72 for the transport trolley 55 of FIG. 2 are shown.

The correspondence of reference numerals applies also to FIG. 8. In the pouring pipe 13 or in the distributor pipe 70 is a channel 50 which is movable by means of a motor 73 between the two positions shown in broken line in the direction of the double arrow. By a displacement of the channel in the distributor pipe 70 the cross-section of the slide valve 14 is cleared so that this can be closed. From the distributor pipe 70 the melt is led in a transfer channel 74 which goes to a pouring arrangement not shown here. For the (mobile) supply of current and cooling water to the furance bottom 8 are provided cable and hose pivoting means 75 which are likewise arranged coaxially with the tipping axis A. In the furnace lid 6 is moreover a temperature measuring lance 76 which is shown here only schematically.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

We claim:

1. An induction furnace comprising: a furnace bottom having a crucible, an induction winding and a gas-tight casing; a lid which fits on the furnace bottom and is releasably connected thereto in gas-tight fashion by a flange joint, said lid having at least one gas connection, a charging valve and a pouring arrangement, and being tiltably supported about a pivot axis in the connected state in a furnace stand by a pivot bearing which is secured to said lid; and a tipping mechanism which engages the lid, wherein the furnace bottom is separable from the lid by unfastening the flange connection, the lid remaining in the furnace stand.

2. The induction furnace of claim 1, wherein the lid is surrounded by a frame structure in the region of its flange, on which the tipping mechanism engages.

3. The induction furnace of claim 1, wherein the lid further comprises a pouring tube in the region of the tipping axis which runs substantially tangentially to a wall of the lid, which is in gas-tight connection with the lid and which is open to the interior of the lid.

4. The induction furnace of claim 1, wherein the crucible has a pouring spout which extends into the pouring tube and temrinates at the tipping axis.

5. The induction furnace of claim 3, wherein the pouring tube is in gas-tight connection with a distributor tube by means of a rotary coupling.

6. The induction furnace of claim 4, wherein the lid is provided on the side diametrically opposite the pouring tube with a gas-tight projection in which is located a slag collecting vessel, and in that the crucible is provided, on the side diametrially opposite the pouring spout, with a pouring lip, over which the slag can run into the slag-collecting vessel when the crucible is tipped oppositely to the pouring position.

7. The induction furnace of claim 6, wherein the gas-tight projection is connected by an air lock with a removal chamber into which the slag-collecting vessel can be taken.

8. The induction furnace of claim 6, wherein the lid is pivotally connected in the region of the projection for the slag-collecting vessel with a working platform, which is held horizontally at all times during the tipping movement of the furnace into the slag run-off position by means of a mechanism.

9. The induction furnace of claim 1, wherein the induction winding is arranged within the gas-tight casing of the furnace bottom.

10. The induction furnace of claim 9, wherein the lid is provided with a gas connection for a shielding gas, and said connection opens into the flange of the lid and communicates at the opening position with a gas conduit located in the flange of the furnace bottom, which opens into a space in between the casing and crucible and in which the induction winding is located.

11. The induction furnace of claim 10, wherein a second gas conduit and an extraction conduit are located at the side of the flange connection opposite the opening position which are likewise in communication via the flange joint.

12. The induction furnace of claim 1, wherein the lid has an upper charging valve which is provided with a horizontal connecting flange for connection to a charge hopper which can be brought up above the furnace.

13. The induction furnace of claim 2, wherein the tipping mechanism comprises at least a first pressure cylinder which is connected at its upper end to the frame structure of the lid by a first connector and at its lower end is connected by a second connector to a link of which the opposite end is connected to the furnace stand by a third connector, said first, second and third connectors lying at the apices of a triangle and all having pivot axes parallel to the tipping axis, said link being movable by at least a second pressure cylinder from a first pivotal region for melt to pouring to a second pivotal region for slag removal.

14. The induction furnace of claim 1, wherein the lid is raisable from a horizontal position of its flange about the tipping axis into a slightly inclined position relative thereto, in which the furnace bottom can be removed to the side from underneath the lid after unfastening the flange joint.

15. The induction furnace of claim 14, wherein a transport carriage with a jacking mechanism is provided for moving the furnace bottom.

* * * * *